US005694645A

United States Patent [19]

Triplette

[11] Patent Number: 5,694,645

[45] Date of Patent: Dec. 9, 1997

[54] FENCING GARMENTS MADE FROM STRETCHABLE, ELECTRICALLY CONDUCTIVE FABRIC

[76] Inventor: Walter W. Triplette, 331 Church St., Elkin, N.C. 28621

[21] Appl. No.: 627,676

[22] Filed: Apr. 2, 1996

[51] Int. Cl.[6] ..... A41D 13/00; A41D 1/04

[52] U.S. Cl. ..... 2/102; 2/108; 2/466

[58] Field of Search ..... 2/102, 456, 466, 2/463, 69, 51, 108, 902, 2.5, 79, 93, 243.1; 273/DIG. 26, 454, 460, 57.3, 371; 463/47.1

[56] References Cited

U.S. PATENT DOCUMENTS

| | | | |
|---|---|---|---|
| 3,657,515 | 4/1972 | Smith | 2/2.16 |
| 3,699,590 | 10/1972 | Webber et al. | 2/69 |
| 3,778,331 | 12/1973 | Scharf . | |
| 3,866,909 | 2/1975 | DeSantis | 2/466 |
| 3,877,965 | 4/1975 | Broadbent et al. | 2/243.1 |
| 4,034,375 | 7/1977 | Wallin | 2/900 |
| 4,064,305 | 12/1977 | Wallin | 2/900 |
| 4,254,951 | 3/1981 | De Laney . | |
| 4,422,483 | 12/1983 | Zins | 2/69 |
| 4,539,714 | 9/1985 | Fratti | 2/108 |
| 4,596,053 | 6/1986 | Cohen et al. | 2/51 |
| 4,753,088 | 6/1988 | Harrison et al. | 2/48 |
| 4,761,005 | 8/1988 | French et al. . | |
| 5,073,984 | 12/1991 | Tone et al. | 2/102 |
| 5,195,752 | 3/1993 | Reeves et al. | 2/102 |
| 5,465,423 | 11/1995 | Taylor-Varney | 2/466 |
| 5,465,424 | 11/1995 | Cudney et al. | 2/466 |
| 5,514,457 | 5/1996 | Fels et al. | 2/2.5 |

*Primary Examiner*—Amy B. Vanatta

*Attorney, Agent, or Firm*—Bell, Seltzer, Park & Gibson, P.A.

[57] ABSTRACT

A garment for use in electrically-scored contact sports competitions is described. The garment is designed to cover at least the upper torso of a wearer, and is fabricated from electrically conductive yarns which cooperate with an electric sports implement to register a score when the implement contacts the electrically conductive garment. At least a portion of the upper torso portion is made from a stretchable, electrically conductive material. The garment is particularly adapted for use in fencing competitions, and can be made substantially entirely from the stretchable electrically conductive material or from a combination of stretchable and non-stretchable conductive materials.

20 Claims, 2 Drawing Sheets

FENCING GARMENTS MADE FROM STRETCHABLE, ELECTRICALLY CONDUCTIVE FABRIC

FIELD OF THE INVENTION

This invention relates generally to a stretchable, electrically conductive garment for use in electrically-scored contact sports, and more specifically to stretchable garments for wear during electrically-scored fencing competitions.

BACKGROUND OF THE INVENTION

Historically, many kinds of contact-type sports competitions were judged according to the injuries which one opponent inflicted to another opponent. Not only did the high probability of injury deter some gifted athletes from participating in these competitions, the audience for such events was necessarily limited to those who could stomach the witnessing of such injuries. In addition, as a result of the injuries received in the course of such competition, the competitors' careers tended to be shortened.

Because of the interest in retaining the sports competitions, while eliminating much of the injury associated therewith, efforts have been made to develop competitive versions of contact-type sports such as fencing, which can be scored by means other than a comparison of competitor injuries. One such method has been utilized in sports such as boxing; the method utilizes judges who score blows inflicted by one opponent on the other solely by their appearance. This system can be undesirable for many reasons. For example, the scoring is extremely subjective, and thus scores can vary as a result of judge bias and ability. Additionally, whether a judge actually sees a scoring contact can depend on his position relative to the fighters, i.e. his line of vision. Because the judges are in different positions from each other, what appears to be scoring contact to one judge may appear to be a pulled punch or near-miss to another judge. Further, the brutality aspect is not completely removed from the scoring since, for example in boxing, a knockout equals a victory no matter what the opponents' respective scores.

In sports which utilize implements which can cause serious injury or death such as fencing, competition is necessarily based on scoring methods other than the actual injuries inflicted to one's opponent for public policy reasons. Therefore, attempts have been made to provide non-injury based methods for scoring such events which do not rely purely on judges' personal subjective perceptions.

One scoring method which has been developed utilizes electrically conductive fencing apparel in combination with fencing implements which are connected to an electronic scoring apparatus. In this method, when a fencing implement such as an electric foil contacts the conductive garment of a user's opponent, the scoring apparatus registers a hit. One such electrical implement/conductive apparel combination is disclosed in U.S. Pat. No. 4,254,951 to De Laney.

The conventional types of electrically conductive apparel have typically been in the form of vests or jackets, commonly referred to as fencing lamés, which are woven to include a plurality of metal wires. Such wire containing garments have many drawbacks. For example, because wire tends to be stiff, the wires typically must be spaced apart sufficiently within the garment so that the wearer can maintain the ability to move somewhat freely. As a result of the spacings between the wires, the scoring device can fail to register a scoring contact by the electric implement of the wearer's opponent, because the implement has contacted a spacing between the wires rather than one of the wires itself. In addition to having a tendency to be inflexible, the wires tend to be cause the garment to be heavy and uncomfortable on the wearer's body. Because the garments are not stretchable, they do not "give" in response to a wearer's movements. Generally, garments which do not stretch are provided to be loose-fitting, so as to not restrict motion; in this case, however, the garments need to be close-fitting in order that only blows which actually contact the competitor's body are recorded. Further, the wires tend to rust, particularly as a result of wearer perspiration. Not only is this aesthetically unappealing, but it can also represent a serious drawback to the life span of the garment, and hinder the garment's electrical conductivity. As an additional disadvantage, wires tend to fatigue in response to bending, and if repeatedly bent, they can eventually break.

Other means for providing electrically conductive scoring apparel have been attempted. For example, U.S. Pat. No. 4,761,005 discloses a device for generating an analog output signal indicating impact to a transducer. The transducer can be mounted on protective equipment such as protective vests and the like, to register impact received as a result of participation in a contact sport such as fencing. The transducer includes a layer of piezo-electric film sandwiched between thin metallized layers of electrically conductive material which can comprise layers of silver. The conductive material is adapted to be provided on regions of a garment which correspond to point-scoring regions of the wearer's body. Because the conductive material is in film form, it is necessarily continuous in the regions where conductivity and contact registrability are desired. Thus certain areas of a competitor's body may not be adequately covered by the transducers, such that some scoring contacts by a competitor's opponent may go unregistered.

Attempts have been made to provide electrical charge conducting fabrics which can be used in clothing, though typically these have been provided for use in environments where static charges can represent a problem to the wearer, such as in certain regions of a nuclear submarine. For example, U.S. Pat. No. 3,778,331 to Scharf describes static charge resistant yarns which can be used to create textile fabrics for clothing and the like. The Scharf patent describes a permeable non-woven web formed of nylon fibers which is plated on its opposing faces with a non-oxidizing metal such as tin, to impart a matte, non-reflective finish thereon. The metallized paper web is then conveyed through a slitter to produce a multiplicity of metallized ribbons, which can be given yarn-like properties by conventional twisting and texturizing techniques. In addition, the ribbons may be supported on a filamentary core of nylon or other thread such as by winding the ribbon around the thread or core. In this way, the Scharf fabric purports to provide a discharge path for electric static charges without visibly introducing glitter or other metallic effects in the product.

Thus, a need exists for electrically conductive apparel which can be used for electronically-scored contact sports such as fencing and which is lightweight and durable. In addition, a need exists for apparel for electronically-scored contact type sports such as fencing, which accurately registers all contacts made by the sports implement and which does not hinder the movements of the competitor.

SUMMARY OF THE INVENTION

With the foregoing in mind, it is an object of the present invention to provide a electrically conductive stretchable garment suitable for use in contact-type sports competitions, and which provides a close and comfortable fit to the wearer.

An additional object of the invention is the provision of a garment which can be made to be substantially wireless, yet is sufficiently electrically conductive to be used in electrically-scored fencing competitions.

These and other objects are achieved by providing an electrically conductive garment which includes portions made from a substantially wireless stretchable, electrically conductive fabric. For purposes of this invention, "stretchable" is defined as being capable of extending or distending in response to a force or stress, then resuming substantially its original shape and dimension upon release of the force or stress.

The garment preferably includes front and rear panels which are integrally formed or joined along their respective sides at first and second side panels, to form an upper torso encircling portion. A crotch panel desirably extends from a lower portion of the front panel, and is adapted to cover the abdominal and crotch regions of a wearer. The crotch panel is also preferably tapered in order to leave the legs of the wearer substantially uncovered in order that their movement is unhindered. This crotch panel can be electrically conductive, as in a foil lamé, or can be non-conductive, for example where the garment is a saber lamé, since in saber competitions the target area does not extend to the crotch region.

The garment preferably includes a mock turtleneck about an upper portion of the front and rear panels, which is adapted to encirclingly cover a portion of a wearer's neck. This turtleneck is desirably formed as a separate collar-type band, and secured to the front and rear panels by conventional methods such as stitching.

An opening is preferably provided along the garment, in order to ease the donning and doffing thereof. In a preferred embodiment of the invention, the opening extends along a side of the front panel to divide the front panel into partial panels. When the garment is worn, these partial panels are overlapped and secured together by mating fasteners, such as hook and loop fasteners. The fasteners are desirably secured to the garment in a position where they do not interrupt the continuous material of the garment outer surface, in order that they do not represent an obstacle to one registering a scoring contact by a fencing implement. It is noted, however, that an opening could be provided in other positions on the garment, such as on a side or the rear panel, and that other types of fasteners such as zippers or the like may also be used. Alternatively, where the garment is formed by a sufficiently large amount of stretchable electrically conductive material, the opening may be dispensed with all together and the garment can be pulled over the wearer's head.

The garment also includes arm openings, which may terminate proximate the torso encircling portion in the form of a sleeveless vest, or which may have sleeves attached thereto. The sleeves can be either electrically conductive or non-conductive.

A strap preferably extends from a lower portion of the crotch panel and is adapted to releasably secure the crotch panel between a wearer's legs when the garment is worn. To this end, a loop is preferably secured to the rear panel of the garment, with a pair of D-rings being threaded therethrough. When the garment is donned, the strap is positioned between the wearer's legs, and the strap is secured to the rear panel by threading it through the D-rings in a conventional manner. In this way, the crotch panel is maintained in its desired position where it can cover and protect the vital organs of the wearer.

Portions of the garment are desirably made from a stretchable, electrically conductive fabric. In a preferred embodiment of the invention, substantially the entire garment, i.e. the front and rear panels, side panels, neck portion, sleeves and crotch panel, where applicable, are made from the stretchable electrically conductive fabric.

In an alternative embodiment of the invention, portions of the garment are made from a non-stretchable conductive fabric while selected portions of the garment are formed from a stretchable conductive fabric. In a preferred form of this embodiment, the majority of the garment is made from a wireless woven conductive material, with sections of the stretchable conductive material being located on the back panel proximate the arm openings, on lower ends of the opposite side portions, and on lower ends of the sleeves, if provided. In this way, a close-fitting garment can be provided which is continuously conductive, and which enables a wearer to move freely.

The stretchable, electrically conductive fabric used to form the stretchable portions of the garment is preferably warp knit from synthetic yarns, then treated to render the fabric electrically conductive. In a particularly preferred form of the invention, the stretchable fabric is warp knit from nylon and spandex yarns, and then plated with silver by way of a conventional chemical deposition process. The stretchable fabric is not only more flexible than the wire materials conventionally used, but it also tends to be lighter and more resistant to oxidation. Because the threads can be knit tightly, the electrical conductivity of the garment can be maintained despite a partial loss of the conductive coating on particular threads, whereas in the conventional wire conductive garments, the garment can become useless following a break in one of the wires, particularly since the wires must be spaced so far apart.

In the embodiment of the invention including a combination of stretchable and substantially non-stretchable electrically conductive portions, it is particularly preferred to use a fabric having non-wire, electrically conductive yarns in a first direction, which is preferably the weft direction, and non-conductive yarns in the second woven direction. It is particularly preferred to use silver plated nylon yarns in a first direction, and non-plated nylon yarns in the other direction of the weave, in the manner disclosed in commonly-assigned pending application Ser. No. 08/546,474, which is incorporated herein by reference. Such a woven fabric has been found to perform well in electronically-scored fencing competition, and avoids the drawbacks typically associated with wire garments. It will be noted, however, that other types of substantially non-stretchable materials such as wire materials or the like, could also be used in combination with the stretchable fabric portions.

BRIEF DESCRIPTION OF THE DRAWINGS

The foregoing and other objects, features and advantages of the present invention will be made apparent from the following detailed description and from the drawings in which.

DETAILED DESCRIPTION

Figure 1:
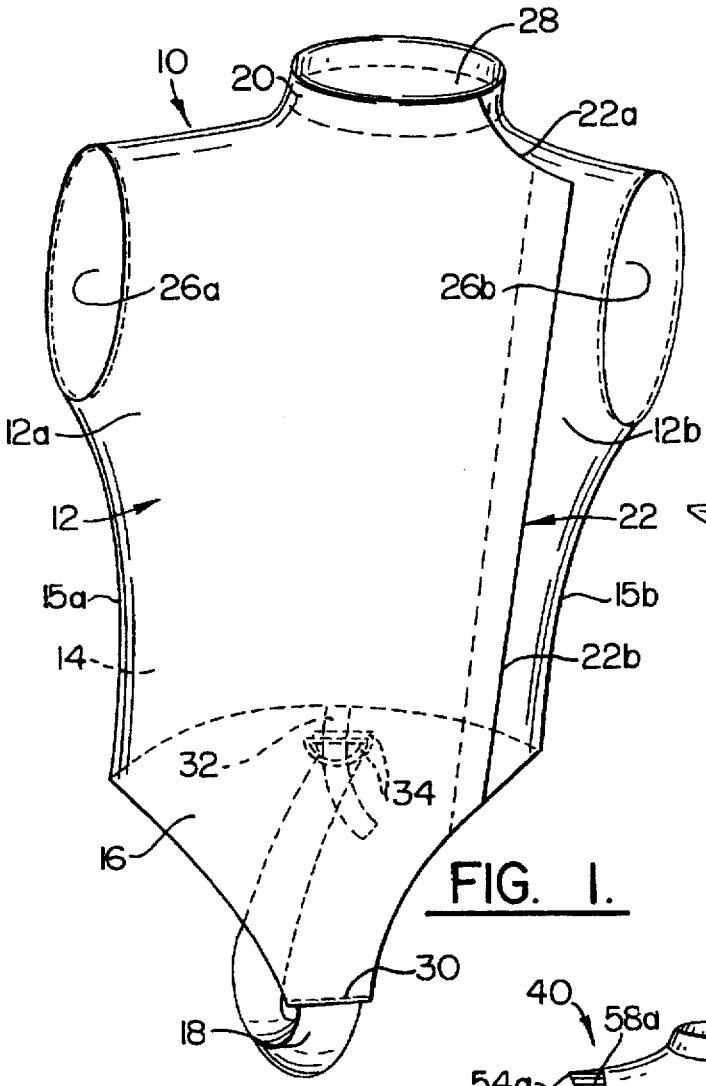
FIG. 1 is a perspective view of a fencing vest according to the present invention.
Figure 2:
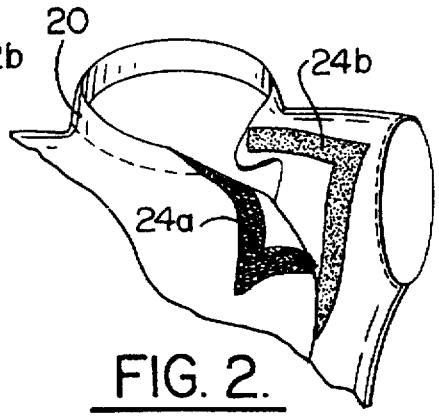
FIG. 2 is a partial sectional view of the vest of FIG. 1 with the front panel being partially opened.

With reference to FIGS. 1 and 2, the invention relates to a fencing garment, as shown generally at 10, which includes stretchable, electrically conductive portions, which allow a close and comfortable fit of the garment to the wearer, and provide sufficient electric conductivity to the garment to enable the garment to be used in electrically-scored contact sports. The garment 10 includes a front panel 12 for covering front torso of a wearer and a rear panel 14 for covering the rear torso of a wearer. First and second sides of the front and rear panels 12, 14 are joined along first and second side panels 15*a*, 15*b* to thereby form an upper torso encircling portion. The front and rear panels 12, 14 can be joined at the respective side panels 15*a*, 15*b* by sewing, gluing, or other conventional methods; alternatively, two or more of the panels can be integrally formed, to minimize the number of material pieces utilized to form the garment, and reduce the number of seaming processes required. The upper torso portion is preferably adapted to fit the wearer snugly, though not so tightly that it tends to restrict the wearer's movements.

A crotch panel 16 desirably extends from a lower portion of the front panel 12 to cover a lower abdominal and crotch region of a wearer. This crotch panel 16 preferably tapers inwardly from the front torso 12, in order that it substantially follows the lines of the human torso from the hip bones down to the crotch region. In this way, the crotch panel 16 can extend comfortably between a wearer's legs while not hindering movement of the wearer's legs where they join the hips. Though other lower torso configurations could be utilized, the tapered configuration depicted is particularly preferred because it does not hinder a wearer from performing the lunging movements which are utilized in the sport of fencing.

The crotch panel 16 can be either electrically conductive or non-conductive, depending on the particular type of competition for which the garment 10 is designed. For example, in saber competitions, the target area terminates proximate the competitor's waist; thus, the crotch panel 16 can be made from a non-conductive material. In contrast, in foil competitions, the target area includes all of the vital organs; thus a garment 10 designed for foil competitions would desirably include a conductive crotch panel 16. In the conductive crotch panel embodiment, the crotch panel 16 is preferably formed as an integral extension of the front panel 12, as this decreases the number of pieces which must be used to construct the garment, and therefore decreases the labor input required for its manufacture.

A strap 18 extends from the lower portion of the crotch panel 16 and is designed to releasably secure the crotch panel between a wearer's legs in order that the wearer's lower abdominal and crotch regions are securely covered by the fencing garment 10. In this way, it can be ensured that the vital organs of the wearer are protected from accidental injury during fencing competitions. In a preferred embodiment of the invention, the strap 18 is designed to be releasably and adjustably securable to the rear panel 14 of the garment 10 in order that the garment can be made to comfortably fit wearers of different sizes.

In a particularly preferred form of the invention, a loop 32 is secured to the rear panel 14 of the garment 10 by way of stitching or other conventional methods of attachment. This loop 32 may be made of nylon webbing, such as is used to form the strap 18. The loop 32 preferably extends through a pair of D-ring type fasteners 34, such that the D-ring type fasteners hang from the rear panel 14 by way of the loop. In this way, when the garment 10 is donned by a wearer, the strap 18 can be positioned between the legs of the wearer, then looped through the pair of D-rings 34, to thereby secure the crotch panel 16 and strap in their proper positions on the wearer's body. While the D-rings 34 are preferred due to their low cost and because they allow a large degree of strap adjustability, it is noted that other forms of attachment can be provided for securing the strap between the wearer's legs, such as snaps, hook and loop fasteners, buttons or the like. As a further alternative, a loose strap can be provided in place of the loop 32 and it could be tied into a knot with the strap 18 to secure the crotch panel in its proper position.

It is also noted that forms of securing the crotch panel 16 about the vital organs of the wearer other than the strap 18 shown could be provided. For example, a patch of hook or loop fastener material could be secured to a lower portion of the crotch panel 16 and a mating piece of fastener material could be secured to the lower torso covering garment worn by the wearer. However, because the strap method discussed above enables the electrically conductive garment 10 to be worn in combination with many types of apparel without requiring alteration thereto, this method is particularly preferred. The strap 18 can be in the form of conventional nylon webbing such as that used to form the straps on bags, back-packs or the like, and may be attached to the crotch panel 16 by way of stitching 30. It will readily be recognized, however, that other forms of attachments such as gluing, thermal bonding or the like could be used to attach the strap to the crotch panel.

The fencing garment 10 desirably has a neck encircling portion 20, preferably in the form of a mock turtleneck, located about an upper portion of the front and rear panels 12, 14, and which is adapted to encircle and cover a portion of a wearer's neck. This mock turtleneck 20 is preferably formed as a separate collar-type band which is secured about upper portions of the front and rear panels 12, 14 in a conventional manner. In a particularly preferred form of the invention, and particularly in embodiments of the invention using non-stretchable materials to form the neck of the garment (which tend to be stiffer and thus more abrasive) a band of edging material (not shown) is secured about the free neck-encircling end (i.e. the upper end) of the mock turtleneck 20, as this provides a smooth edge thereto. In this way, the free or upper end of the mock turtleneck can be kept from chafing the skin on the wearer's neck, which can tend to be particularly tender. It is noted, additionally, that the length of the turtleneck 20 could be extended in the form of a standard full turtleneck, or shortened to extend to a lesser extent, if at all, on the wearer's neck.

The garment 10 also desirably includes an opening 22 extending along at least a portion of its vertical length in order that the garment can be easily donned and doffed. This opening 22 preferably extends along a side of the front panel 12 to divide the front panel into partial panels 12*a* and 12*b*, as this position has been found to produce an easily donnable garment. The opening 22 of this preferred embodiment desirably includes a substantially horizontally extending portion 22*a* and substantially vertically extending portion 22*b*. This opening configuration coupled with the offset position thereof provides a smooth fit of the mock turtleneck portion 20 and the garment 10, while providing a substantially uninterrupted surface about the center of the front panel 12. Because the majority of the fencing blows are typically received in the center of the front panel 12, this embodiment provides the advantage of a relatively uninterrupted target area. It will be noted, however, that other opening locations and configurations can be provided, e.g.

the back or side torso encircling portion, without departing from the spirit of this invention. Further, in embodiments of the invention where a substantial portion of or the entire upper torso portion and neck portion are made from the stretchable electrically-conductive material, the opening may be eliminated altogether, and the garment may simply be pulled over the wearer's head.

As shown more clearly in FIG. 2, the opening 22 is selectively closable by overlapping partial panels 12*a*, 12*b* and securing them by way of mating fasteners 24*a* and 24*b*. Although the mating fasteners illustrated are of the hook and loop variety, other types of conventional fasteners, such as snaps, zippers and the like could be used in addition to or in place of the hook and loop fasteners shown. It is preferred that the fasteners 24*a*, 24*b* be provided on the underside of the overlapping partial panel portion (here portion 12*a*) and the upper side of the overlapped partial panel portion (here portion 12*b*) in order that the electrically conductive fabric is not interrupted by fasteners on the outer surface of the garment. In this way, the electrically conductive fabric is continuous about the outwardly facing surface of the garment, and there are no fasteners on the garment outer surface which can interfere with a wearer's opponent registering a hit due to contact with a fastener rather than the conductive fabric. It has been found that the hook and loop fasteners 24*a* and 24*b* illustrated securely close the opening 22 and allow a small amount of adjustability to the garment as well, since the hook and loop fasteners can be slightly offset while still effecting a secure engagement. In addition, these hook and loop fasteners are known to be cost effective and they do not have the negative side effects typical of some other closures, e.g. the tendency for metal zippers and snaps to rust.

As illustrated in FIGS. 1 and 2, the garment includes arm openings 26*a* and 26*b* for receiving the arms of a wearer. The garment 10 can be substantially sleeveless, to form a vest substantially as shown. Alternatively, the garment could be provided with sleeves (not shown) in a conventional manner, to form a short sleeved or three-quarter length to long sleeved jacket. In the sleeved embodiments, the sleeves can be made from the same electrically conductive fabric as is used to make other parts of the garment (discussed further herein). Alternatively, in situations where it is not considered important for the sleeves to be electrically conductive, they can be made from non-conductive material. The sleeves, where used, can include means for securing them about a wearer's wrist or arm, if desired.

In the embodiment illustrated in FIGS. 1 and 2, substantially the entire upper torso portion of the garment is made from stretchable electrically conductive material. The crotch panel 16 can also be made from the stretchable electrically conductive material where it is desired for that portion of the garment to be electrically conductive.

The stretchable electrically conductive fabric is desirably warp knit from synthetic yarns, which is in turn treated to render it electrically conductive. Preferred is a fabric knit from 85% or greater of nylon yarns and 15% or less of spandex yarns such as those sold under the tradename LYCRA, as this combination of yarns has been found to receive the conductive plating well. A preferred fabric is a Raschel knit nylon and spandex fabric where the spandex yarns are inlaid in the weft direction. 30–200 denier, 25–50 filament nylon yarns have been found to perform well in the invention. A particularly preferred fabric is a 94% nylon, 6% spandex Raschel knit fabric knit from 70 denier, 34 filament nylon yarns. It will be noted that other knit fabrics, including other warp knit structures such as tricot and weft knit structures, could also be used within the spirit of the invention, so long as they provide sufficient stretchability and electrical conductivity.

To render the fabric electrically conductive, the fabric is desirably plated with a conductive material. A particularly preferred method for treating the fabric is by plating it with silver using a conventional chemical deposition process. Other processes can be used within the spirit of the invention. Alternatively, the yarns themselves could be treated prior to knitting or otherwise forming them into a stretchable fabric; this method is less preferred, however, due to the greater difficulty and expenses which would be associated with this method.

To conform with competitive fencing regulations, the garment desirably includes a full-lining 28 which is preferably made from a nylon fabric. Preferably, the lining in the full-stretch embodiment of the invention illustrated in FIGS. 1 and 2 is knit so that it stretches along with the outer layer. However, it will readily be recognized that other types of lining materials conventionally known in the art could also be used. Further, an internal lining which is adapted to be more comfortable (e.g. softer) to a wearer could be provided in addition to or instead of the nylon lining 28. As a further alternative, the lining could be provided in only portions of the garment, as for example in the sleeved jacket embodiment, the torso portion of the garment could be lined while the sleeves remain substantially unlined.

Figure 3:
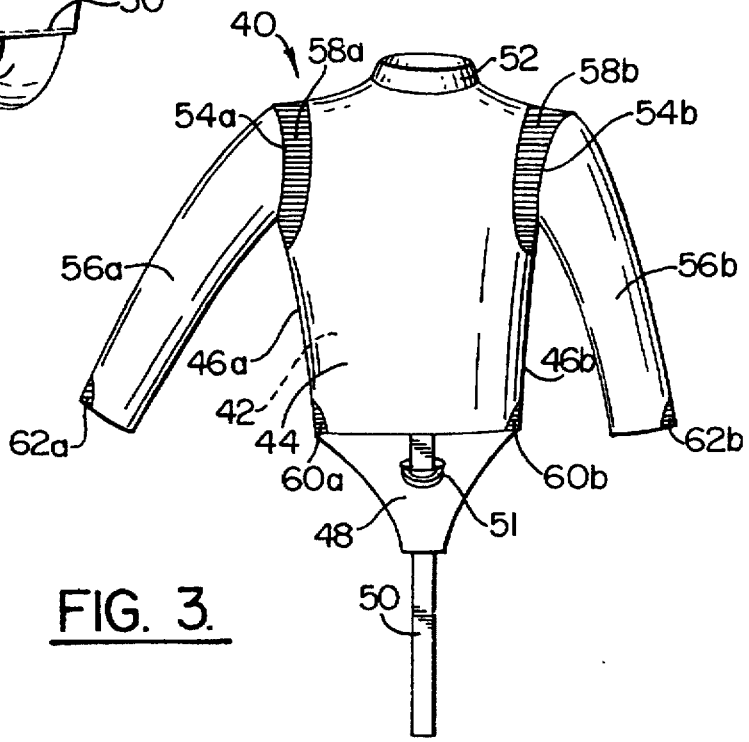
FIG. 3 is a perspective view of a back of an alternative embodiment of the present invention.
Figure 4:
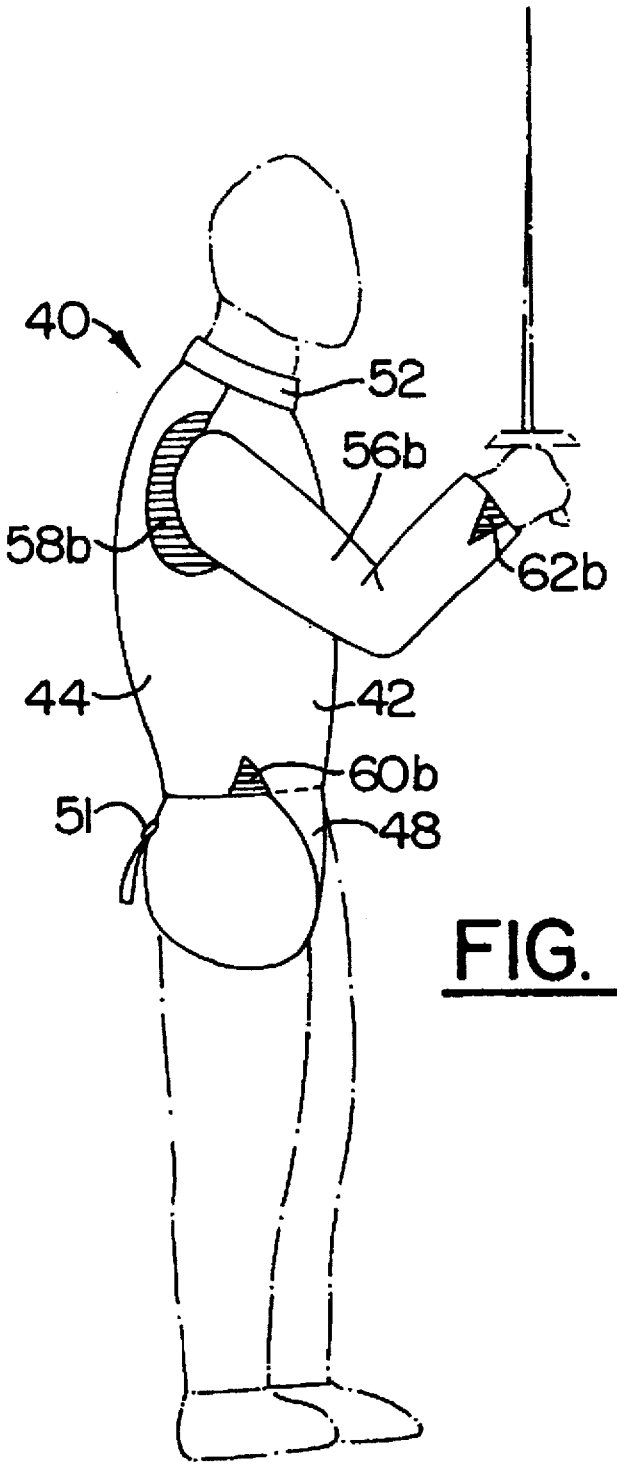
FIG. 4 is a side view of the garment of FIG. 3, as it would appear on a wearer's body.

An alternative embodiment of the present invention, which is in the form of a sleeved jacket 40, is illustrated in FIGS. 3 and 4. The jacket 40 includes front and rear panels 42, 44, respectively, which are joined together along first and second side panels 46*a*, 46*b* to form an upper torso encircling garment.

A crotch panel 48 extends from a lower portion of the front panel 42 to cover a lower abdominal and crotch region of the wearer. This crotch panel preferably tapers inwardly from the front panel 42, in order that it substantially follows the lines of the human torso from the hip bones down to the crotch region. In this way, the crotch panel 48 can extend comfortably between a wearer's legs while not hindering movement of the wearer's legs where they join the hips. Though other lower torso configurations could be utilized, the tapered configuration depicted is particularly preferred because it does not hinder a wearer from performing the lunging movements which are utilized in the sport of fencing.

The crotch panel 48 can be either electrically conductive or non-conductive, depending on the particular type of competition for which the garment is designed. For example, in saber competitions, the target area terminates proximate the competitor's waist; thus, the crotch panel can be made from a non-conductive material. In contrast, in foil competitions, the target area includes all of the vital organs; thus a garment designed for foil competitions desirably includes a conductive crotch panel 48. In this embodiment, the crotch panel 48 is preferably formed as an integral extension of the front panel 42, as this decreases the number of pieces which must be used to construct the garment 40, and therefore decreases the required input of labor required for its manufacture.

A strap 50 desirably extends from the lower portion of the crotch panel 48 and is designed to releasably secure the crotch panel between a wearer's legs in the same manner discussed with respect to the embodiment of FIGS. 1 and 2. As discussed previously, the use of a strap secured to the crotch panel 48 in combination with a fastener 51 located on the rear panel 44 is the preferred means of securing the crotch panel in place, though other securement means can be employed.

The fencing garment 40 preferably has a neck encircling portion 52, preferably in the form of a mock turtleneck, located about an upper portion of the front and rear panels 42, 44, which is adapted to encircle and cover a portion of a wearer's neck. This mock turtleneck 52 is preferably formed in the same manner as discussed with respect to the embodiment of FIGS. 1 and 2, and can be formed from either stretchable or non-stretchable material. In the embodiment illustrated in FIGS. 3 and 4, the neck portion 52 is desirably made from a non-stretchable material.

The garment 40 also desirably includes an opening (not shown) for assisting in the donning of the garment, in the same manner discussed with respect to the embodiment of FIGS. 1 and 2. Alternatively, in embodiments of the invention where a sufficient portion of the upper torso portion is made from the stretchable electrically-conductive material, the opening may be eliminated altogether, and the garment may simply be pulled over the wearer's head.

The garment 40 includes arm openings **54*a* and 54*b* for receiving the arms of a wearer. The garment 40 can be substantially sleeveless, in the form of a vest, or include sleeves 56*a*, 56*b*, as illustrated, to form a jacket. Such sleeves can be of any length, according to the preferences of the manufacturer and the intended wearer of the garment. In the sleeved embodiments, the sleeves 56*a*, 56*b*** can be made from the same electrically conductive fabric as is used to make other parts of the garment. Alternatively, in situations where it is not considered important for the sleeves to be electrically conductive, they can be made from non-conductive material.

In the embodiment illustrated in FIGS. 3 and 4, the garment 40 is made substantially from non-stretchable electrically conductive material, and includes strategically positioned inserts of stretchable electrically conductive material. A first pair of stretchable panels **58*a*, 58*b* is desirably located on the rear panel 44 of the garment 40, proximate the arm openings 54*a*, 54*b***, in order that the stretch is concentrated at the shoulder regions of the wearer. It has been found that by providing the stretch panels in this region, a close-fitting, non-binding garment can be provided which is sufficiently electrically conductive to be used in electrically scored contact sports. This configuration of stretchable panels has been found to be particularly desirable in providing a garment which does not limit a fencer's ability to perform the dramatic slashes and lunges unique to the sport.

Stretchable panels **60*a*, 60*b*, are also desirably provided proximate lower ends of the side panels 46*a*, 46*b*, to fit the garment closely and securely about a wearer's waist. In a particularly preferred form of the invention, the stretchable panels 60*a*, 60*b*** are substantially triangular shaped.

In the sleeved embodiment of the invention, it is desirable to provide stretchable panels **62*a*, 62*b* proximate the lower end of each of the sleeves 56*a*, 56*b*. In this way, the sleeves 56*a*, 56*b* can be securely tightened about the wearer's wrist or arm. In addition, supplemental means for securing the sleeves 56*a*, 56*b*** can also be provided, as desired.

As discussed previously, the stretchable non-conductive material is desirably wireless in order to overcome the disadvantages associated therewith. The non-stretchable portions of the garment, which in the embodiment of FIGS. 3 and 4 are desirably all of the remaining portions of the upper torso portion, neck portion 52, and crotch panel 48, can be made from any of a variety of electrically conductive, non-stretchable materials. Preferred are woven fabrics formed from electrically conductive yarns of plated synthetic fibers, e.g. silver plated nylon yarns.

To conform with competitive fencing regulations, the garment desirably includes a full-lining (not shown) which is preferably made from a nylon fabric. It is particularly preferred that a stretchable lining be used at least in the regions of the garment 40 corresponding to the stretchable electrically conductive material, in order that its stretching is not hindered. However, it will readily be recognized at other types lining materials conventionally known in the art could also be used.

The conductive garment 10 according to the present is used in the manner of conventional wire garments in combination with specially constructed implements and an electronic scoring device. Where the garment is a fencing vest or jacket, the garment is preferably attached to a scoring device by way of a body cord. Another body cord is attached to the fencing implement, e.g. fencing foil or saber, of the wearer's opponent, to connect the implement to the scoring device. The body cords are preferably connected to cable reels, in order that they can readily be wound and unwound as the athletes move during competition. An electrical path runs through the body cord to the tip of the fencing implement, which is depressible upon contact, for example. The depressible tip is specially constructed so that the electrical path is modified as a result of contact with the conductive jacket, and the contact is registered by the scoring apparatus. Likewise, the tip can be adapted to register contact with non-conductive objects, with the scoring apparatus differentiating between the hits to the respective targets based on their conductivity or lack thereof. Such electrical scoring device/sports implement combinations which utilize conductive targets are known in the art, and the present invention could be used in combination with any of such conventional devices, with the invention not being limited to a particular type of scoring implement or registering device.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. An electrically conductive garment comprising:

an electrically conductive upper torso encircling portion for covering an upper torso of a wearer, a crotch panel extending from a lower portion of said upper torso encircling portion for covering a lower abdominal and crotch region of a wearer, and a strap for releasably securing said crotch panel between a wearer's legs, wherein at least a portion of said electrically conductive upper torso portion is stretchable.

2. The garment according to claim 1, wherein substantially the entire upper torso portion is stretchable.

3. The garment according to claim 2, wherein said crotch panel is electrically conductive and stretchable.

4. The garment according to claim 1, wherein said crotch panel is electrically conductive.

5. The garment according to claim 1, wherein said upper torso portion comprises front and rear panels joined at opposite side panels, with each of said side panels including an arm opening, and a stretchable panel of electrically conductive material forming a portion of said rear panel proximate each of said arm openings.

6. The garment according to claim 1, wherein said upper torso portion comprises front and rear panels joined at opposite side panels, and wherein a stretch panel of electrically conductive material is located proximate a lower end of each of said side panels.

7. The garment according to claim 1, further comprising first and second sleeves secured to opposite sides of said upper torso portion, and wherein a stretchable panel of electrically conductive material is located proximate a lower end of each sleeve remote from said upper torso portion.

8. The garment according to claim 1, wherein said upper torso portion comprises front and rear panels, and further comprising a fastener located proximate a lower end of said rear panel for releasable securement of said strap.

9. The garment according to claim 1, wherein said stretchable portion of said electrically conductive upper torso portion comprises a wireless, electrically conductive warp knit fabric.

10. The garment according to claim 1, wherein said stretchable portion comprises a silver-plated warp knit nylon fabric.

11. The garment according to claim 10, wherein said warp knit nylon fabric is knit from nylon yarns about 30–200 denier in size.

12. The garment according to claim 1, wherein said upper torso portion comprises front and rear panels joined at opposite side panels, with each of said side panels including an arm opening, and stretchable panels of electrically conductive material are positioned on said rear panel proximate each of said arm openings and proximate a lower end of each of said side panels, while remaining portions of said upper torso portion are substantially non-stretchable.

13. The garment according to claim 12, further comprising first and second sleeves secured to opposite sides of said upper torso portion, and wherein a stretchable panel of electrically conductive material is located proximate a lower end of each sleeve remote from said upper torso portion.

14. An electrically conductive garment for use in electrically-scored contact sports competitions comprising:

an upper torso portion for covering at least an upper torso of a wearer, said upper torso portion being substantially entirely electrically conductive and at least a portion of said upper torso portion being stretchable, wherein said upper torso portion comprises a warp knit substantially wireless electrically conductive fabric comprising nylon and spandex yarns and which is silver plated to an extent sufficient to render it electrically conductive.

15. The garment according to claim 14, further comprising a crotch panel extending from a lower portion of said upper torso portion for covering a lower abdominal and crotch region of a wearer, and a strap for releasably securing said crotch panel between a wearer's legs.

16. The garment according to claim 14, wherein said upper torso portion comprises front and rear panels joined at opposite side panels, with each of said side panels including an arm opening, and further comprising a stretchable panel located on said rear panel proximate each of said arm openings.

17. The garment according to claim 14, wherein substantially the entire upper torso portion is stretchable.

18. The garment according to claim 14, further comprising a pair of sleeves, each of said sleeves including a stretchable electrically conductive insert proximate its lower end.

19. The garment according to claim 14, wherein said upper torso portion includes a stretchable electrically conductive panel proximate its lower end.

20. An electrically conductive garment comprising:

an electrically conductive upper torso portion for covering an upper torso of a wearer, said upper torso portion including front and rear panels joined at opposite side panels, with each of said side panels including an arm opening, a stretchable panel of silver-plated, warp knit electrically conductive material forming a portion of said rear panel proximate each of said arm openings, a stretchable panel of silver-plated, warp knit electrically conductive material forming a portion of each of said side panels proximate a lower portion thereof, a crotch panel extending from a lower portion of said upper torso encircling portion for covering a lower abdominal and crotch region of a wearer, and a strap for releasably securing said crotch panel between a wearer's legs.

* * * * *